US010537145B2

(12) United States Patent
Borrás Esteve

(10) Patent No.: US 10,537,145 B2
(45) Date of Patent: Jan. 21, 2020

(54) HAIR-FRIENDLY SWIMMING CAP

(71) Applicant: Isabel Borrás Esteve, Baton Rouge, LA (US)

(72) Inventor: Isabel Borrás Esteve, Baton Rouge, LA (US)

(73) Assignee: Isabel Borrás Estevg, Baton Rouge, LA (US)

( * ) Notice: Subject to any disclaimer, the term of this patent is extended or adjusted under 35 U.S.C. 154(b) by 304 days.

(21) Appl. No.: 15/595,282

(22) Filed: May 15, 2017

(65) Prior Publication Data

US 2018/0027912 A1 Feb. 1, 2018

Related U.S. Application Data

(60) Provisional application No. 62/494,079, filed on Jul. 26, 2016.

(51) Int. Cl.

| | |
|---|---|
| ***A42B 1/12*** | (2006.01) |
| *A63B 33/00* | (2006.01) |
| *A45D 8/40* | (2006.01) |

(52) U.S. Cl.

CPC ..... *A42B 1/12* (2013.01); *A45D 8/40* (2013.01); *A63B 33/00* (2013.01)

(58) Field of Classification Search

CPC ..... A42B 1/12; A42B 1/20

See application file for complete search history.

(56) References Cited

U.S. PATENT DOCUMENTS

| | | | | |
|---|---|---|---|---|
| 3,138,801 | A * | 6/1964 | Brodsky | A42B 1/12 2/174 |
| 3,370,304 | A * | 2/1968 | Pelletier | A42B 1/061 2/174 |
| 3,714,670 | A * | 2/1973 | Pollack | A42B 1/12 2/183 |
| 3,793,110 | A * | 2/1974 | Saunders | A42B 1/12 156/247 |
| 8,613,114 | B1 * | 12/2013 | Olivares Velasco | A42B 3/125 2/411 |
| 9,398,780 | B1 * | 7/2016 | Matallana | A42B 1/12 |
| 10,051,907 | B2 * | 8/2018 | Dammann | A42B 1/22 |
| 2009/0038048 | A1 * | 2/2009 | Thompson | A42B 1/12 2/68 |
| 2010/0192273 | A1 * | 8/2010 | Dodd | A63B 33/00 2/68 |
| 2015/0000002 | A1 * | 1/2015 | Brown | A42B 1/12 2/68 |
| 2015/0335086 | A1 * | 11/2015 | Murphy | A42B 1/041 2/171 |

(Continued)

*Primary Examiner* — Richale L Quinn

(57) ABSTRACT

An article of swim gear consisting of a cap for protecting the hair during the practice of recreational swimming or other aquatic sports. The cap comprises a main body whose tripartite structure allows the accommodation of the hair without squeezing it, thus maintaining the shape of the hairdo. The cap also comprises an internal positioning-blocking unit consisting of an annular band attached to the rim of the cap by only one of its edges, which gently holds the cap to the user's head, and a seepage-prevention strip cantilevered over the outer face of the annular band, which stops and absorbs the water that could seep under the edge of the cap in the areas of neck and temples. Three embodiments of the cap are described and graphically illustrated.

10 Claims, 7 Drawing Sheets

(Embodiment "A")

(56) References Cited

U.S. PATENT DOCUMENTS

| | | | | |
|---|---|---|---|---|
| 2016/0100648 | A1* | 4/2016 | De Jesu | A42B 1/12 2/174 |
| 2016/0206072 | A1* | 7/2016 | Rich | A45D 20/00 |
| 2016/0309872 | A1* | 10/2016 | Domizi | A45D 19/18 |
| 2017/0027262 | A1* | 2/2017 | Palmer | A42B 1/12 |
| 2017/0042267 | A1* | 2/2017 | Guice | A42B 1/041 |
| 2017/0360138 | A1* | 12/2017 | Guice | A42B 1/12 |
| 2018/0235301 | A1* | 8/2018 | Jude | A42B 1/241 |

* cited by examiner (Embodiment "A")

(Embodiment "A")

(Embodiment "A")

(Embodiment "A")

(Embodiment "B")

(Embodiment "C")

(Embodiment "C")

HAIR-FRIENDLY SWIMMING CAP

CROSS-REFERENCE TO RELATED APPLICATIONS

This application claims the benefit of Provisional Patent Application No. 62/494,079, filed Jul. 26, 2016 by the present inventor.

FEDERALLY SPONSORED RESEARCH

Not Applicable

SEQUENCE LISTING

Not Applicable

BACKGROUND

1. Field

This invention relates generally to swimming gear, and more concretely to swimming caps aimed at protecting the hairstyle and preventing the hair from getting wet during aquatic sports recreational practice, both in a comfortable and inconspicuous manner.

2. Prior Art

Nowadays, swimming gear manufacturers seem particularly interested in making swimming caps whose materials and design help reduce the friction of the head in the water, thus improving the speed of competitive swimmers, usually their main clients.

Apparently, those manufacturers seem to forget other cap users, like the recreational swimmers of all ages, who would like to have swimming caps that were roomy, watertight, comfortable, and discreet.

The absence of caps featuring all those four qualities, coupled with the fact that swimming cap use is mandatory in many aquatic facilities, results in a lot of people giving up on going to such facilities, and thus, on the health benefits of aquatic exercise.

However, in spite of the apparent lack of interest by the manufacturers, many are the inventors who have long been trying to achieve swimming caps featuring one or more of the aforesaid qualities.

Representative examples of inventions particularly interested in the roominess of the swimming cap include those disclosed in U.S. Pat. No. 2,465,998 to Bowditch (1949), U.S. Pat. No. 3,206,761 to Melnikolf (1965), U.S. Pat. No. 20,150,000,002 to Brown (2015), U.S. Pat. No. 3,996,621 to Martienssen (1974), and U.S. Pat. No. 20,140,109,281 to Waller, Johnson, and Neal (2014).

To achieve capriciousness, the cap in Bowditch's patent resorts to a lodging cavity for the hair, composed of several wide segments of rigid material that fold in the back of the head on both sides of a zipper that, when closed, constricts them and tightens the back of the cap. The cap also has a strap that, when fastened under the chin, ensures the grip of the cap's front.

The cap in Melnikolf's patent consists of a hemispherical piece with drawstrings, crimped with eyelets, which shrink the volume of the piece until it adjusts to that of the user's hair. Contoured by a band with a clasp for fastening the cap to the user's head, the hemispherical piece features a bellow of lateral expansion that facilitates the accommodation of the hair.

The patent to Brown reveals a cap that resembles a wide shower cap bordered by a silicone adjustment band. Given its wideness, the cap easily adapts to different head sizes and accommodates hairstyles of various length and volume.

Martienssen's patent presents a cap composed of a flexible receptacle that wraps the hair loosely, a tightening annular band composed of three segments whose length and shape follow the hairline in the forehead, temples and neck areas, and an oval ring that connects the receptacle to the band.

The cap shown in Waller, Johnson, and Neal's patent consists of a cavity made of fabric or other materials, bordered internally by a silicone band. The volume of the cavity widens in the area below the upper nuchal line and the outer protuberance of the occipital bone, to accommodate there the long hair pulled back into a bun; this minimizes the depression of said area and, consequently, improves head's resistance to hydrodynamic forces.

Illustrative examples of inventions mainly concerned with the swimming cap's watertightness include those revealed in U.S. Pat. No. 20,100,192,273 to Dodd (2010), U.S. Pat. No. 5,349,702 to Runckel (1994), U.S. Pat. No. 2,285,659 to Thomas (1942), and ES Pat. No. 1,074,697 U to Cerezo Miró (2012).

The patent to Dodd discloses a cap including a concave-shaped shell and a resilient margin attached to the shell's edge. To enhance its tightness, the cap may additionally include two straps that engage the said margin in the area of the ears and fasten in the back of the neck through a securing mechanism like a hook-and-loop fastener.

The cap in Runckel's patent comprises a hemispherical cavity that encloses the crown of the wearer's head, outlined by a margin that encompasses the wearer's forehead, temples, and back of the neck. The cap further comprises an inner sealing structure consisting of an inflatable air chamber overlaid by a ribbon of foam material. When inflated, the chamber, backed up by the foam ribbon, seals the large and small protrusions of the head, thus avoiding possible seepage.

Thomas' patent shows a cap featuring a main cavity and a pair of flexible ribs that run parallel to the edge of the cavity's inner side. The ribs are upheld by a flexible mounting in such a way that when the wearer's head presses against them, they swing away from each other and toward the cavity's inner face. In so doing, the ribs force the air out of the space between them, thus impeding potential filtrations.

The patent to Cerezo Miró discloses a cap composed of an inflatable air chamber with a decompression valve, bordered by an elastic head-fitting ribbon. Covered by a standard swimming cap of textile or other material, the chamber is filled by a vacuum pump coupled to its decompression valve.

All being valuable, the foregoing models are not without limitations such as the following:

1) the hair holding receptacles of some of the caps addressing roominess (e.g., patents to Brown and to Martienssen) lack the structure needed to properly maintain the hairstyle shape. Moreover, the voluminousness of those receptacles makes the caps too conspicuous, which may prevent their popularization among many water sports practitioners;

2) the structuring of the hair holding receptacle in some other roominess-geared caps, may raise some issues. For instance, the cap in Waller, Johnson, and Neal's patent, features a protrusion in its cavity's nuchal area for lodging long hair, which is meant to improve hydrodynamics. Such protrusion however, may compromise the cap's tightness, since the weight of the hair therein may cause seepages by pressing downwards the cap's tightening band; and 3) certain devices featured by some of the models are somewhat problematic. For instance, the zippers, snap fasteners, drawstrings, or eyelets used by the caps aiming at spaciousness (e.g., patents to Bowditch and to Melnikolf) can deteriorate rapidly upon contact with the chemicals used for water sanitation in aquatic facilities. In the same way, the straps, snap closures, inflatable chambers, or vacuum valves used by the caps seeking leakproofness (e.g., patents to Dodd, to Runckel, and to Cerezo Miró), may be uncomfortable, cumbersome to handle, and easily breakable.

Thus, in light of the prior art that illustrate, among others, the aforementioned models, it seems that there is still room for creating a swimming cap that, like the one described next, maintains the hairstyle shape, prevents the hair from getting wet, is comfortable to wear, and attracts the target user because of its inconspicuousness.

BRIEF SUMMARY OF THE INVENTION

This invention deals with the Hair-Friendly Swimming Cap, a cap that admits, among other possible ones, three embodiments, "A," "B," and "C," and consists of a main body to accommodate the hair with relative roominess, and thus without deforming the hairstyle, and an internal positioning-blocking unit for securing the cap's fitting and watertightness.

The main body comprises: 1) an upper portion in the shape of a spherical cap that prevents the top of voluminous hairdos from being flattened or allows long hair to be collected in a compact manner (e.g., bow or ponytail); 2) a middle portion in the form of a spherical zone whose structure gives stability to the cap's shape and provides adequate space to accommodate the bulk of the hair; and 3) a lower portion consisting of a concave surface of revolution which enables the cap to contact the user's head below the hairline and to separate from it above that line.

The positioning-blocking unit includes a clamping annular band attached to the edge of the lower portion of the main body by only one of its edges, which increases the band's ductility and comfort. The unit further includes a seepage-prevention strip that attached to the outer face of the annular band in the nape area, stops the water that could seep through the rim of the cap in that area.

In its three embodiments, the cap could include two additional seepage-prevention strips, also attached to the clamping annular band, which would cover the areas on the right and left sides of the skull, from below the hairlines of the temples to the ears. Given the often concave shape of their contour, such areas could become additional water entry points.

Also in its three embodiments, the cap could be manufactured in various sizes. Quantitative data from a large population sample, about skull and neck dimensions and about hairstyles volumes, would help determine the various parameters of the different cap's sizes, including, among others, the height and width of the three portions of the cap's main body, the diameter of the clamping annular band, and the width of the seepage-prevention strip.

The aforesaid components and traits of this new swimming cap will become obvious from the brief and detailed depictions of the three embodiments of the cap given below.

DRAWINGS: BRIEF DESCRIPTION

Certain embodiments of the present invention, the Hair-Friendly Swimming Cap, include, but are not limited, to the ones depicted in the Figures below. They comprise embodiment "A," dealt with by FIGS. 1 to 4; embodiment "B," addressed by FIG. 5; and embodiment "C," illustrated by FIGS. 6 and 7.

Embodiment "A"

Embodiment "B"

Figure 5:
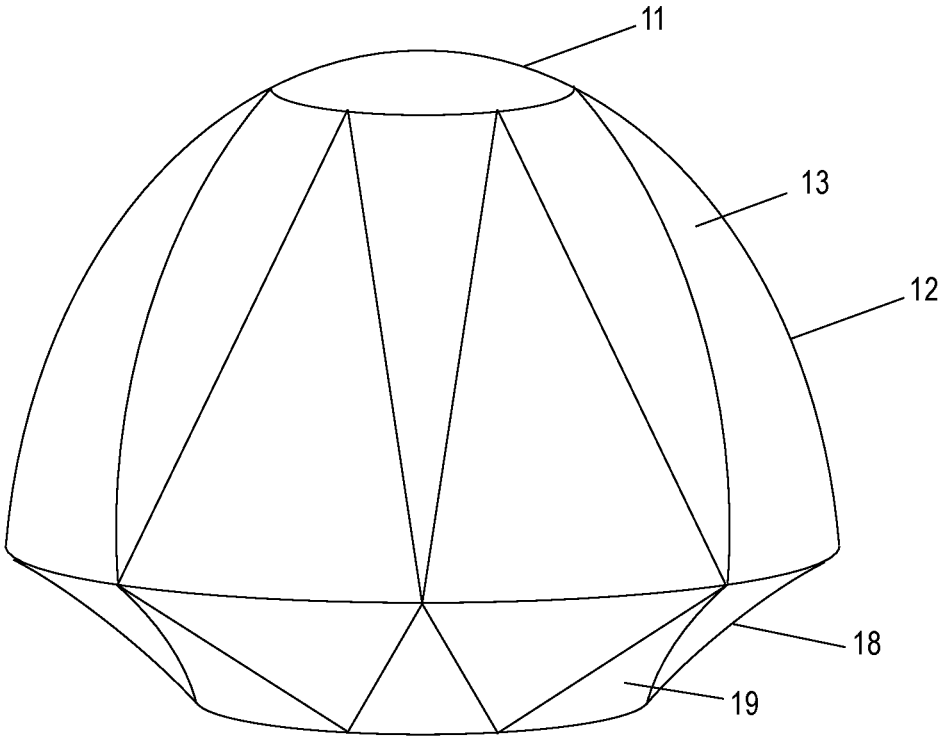

FIG. 5 is a frontal perspective view of the cap.

Embodiment "C"

Figure 6:
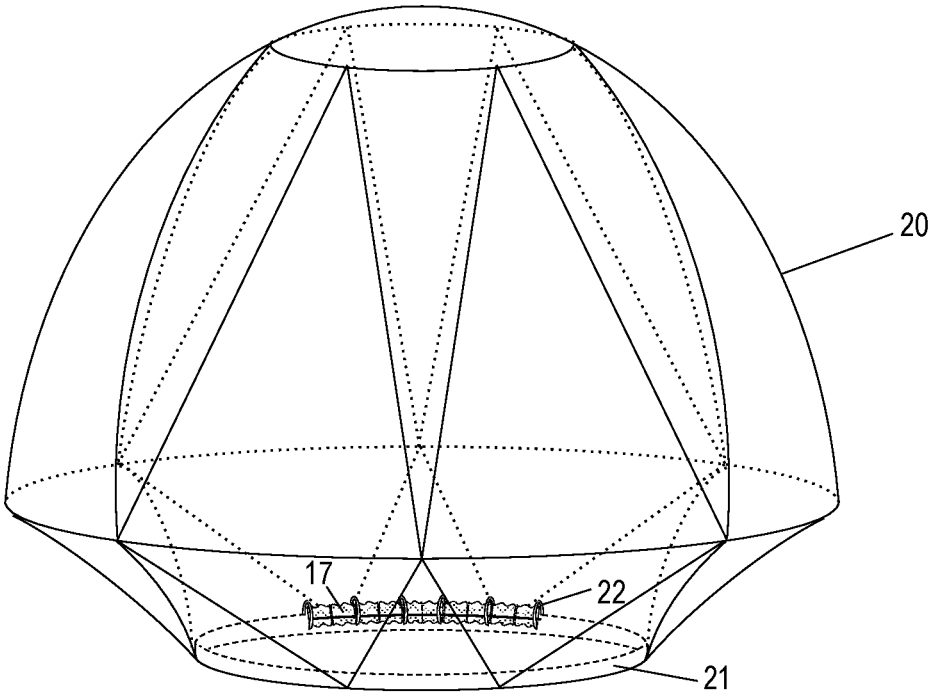

FIG. 6 is a frontal perspective inner view of the cap.

Figure 7:
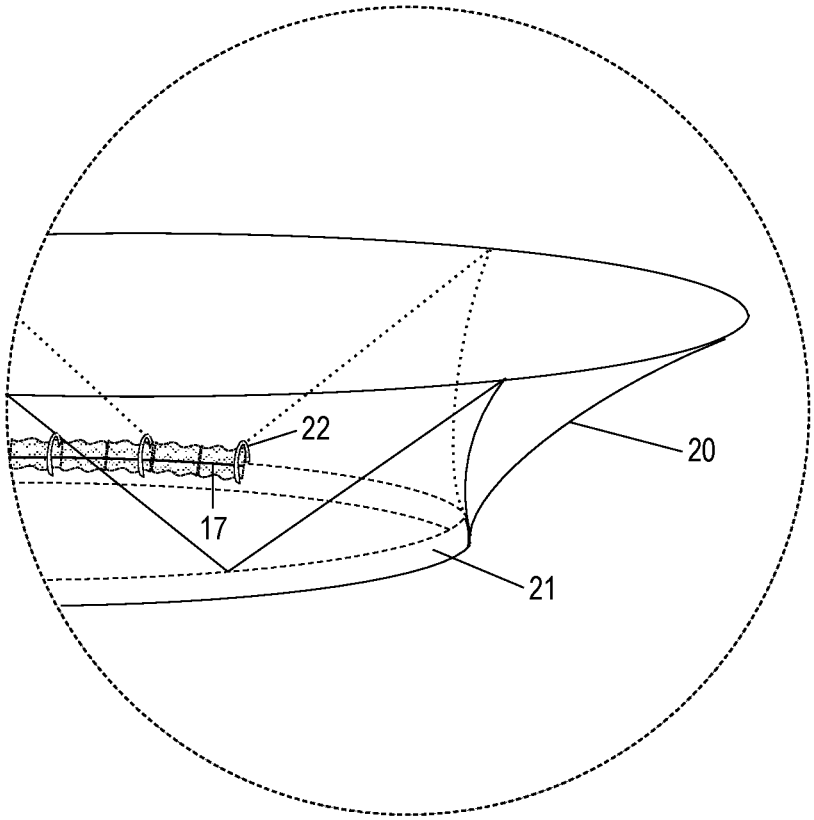

FIG. 7 is a frontal perspective inner view of an amplified fragment of FIG. 6 highlighting the cap's inside components 17, 21, and 22.

DRAWINGS: REFERENCE NUMERALS

List of the numerals of parts referenced in the drawings:

11 upper portion of the swimming cap in the form of a spherical cap
12 middle portion of the swimming cap shaped like a spherical zone
13 one of the twelve pieces of material that make up the middle portion of the cap
14 lower portion of the swimming cap in the form of a concave surface of revolution
15 shirring that covers a fringe of lower portion 14
16 clamping annular band that secures the positioning of the cap on the user's head
17 seepage-prevention strip attached to 16
18 in embodiment "B," lower portion of main body of the cap
19 in embodiment "B," one of the twelve pieces that make up lower portion 18
20 in embodiment "C," the main body of the cap molded in one piece
21 in embodiment "C," clamping annular band consisting of an extension of 20 bending inward from the edge of the cap's opening
22 in embodiment "C," belt loop that keeps the seepage-prevention strip 17 tied to 21

DETAILED DESCRIPTION OF THE INVENTION

Embodiment "A"—FIGS. 1 to 4

Figure 1:
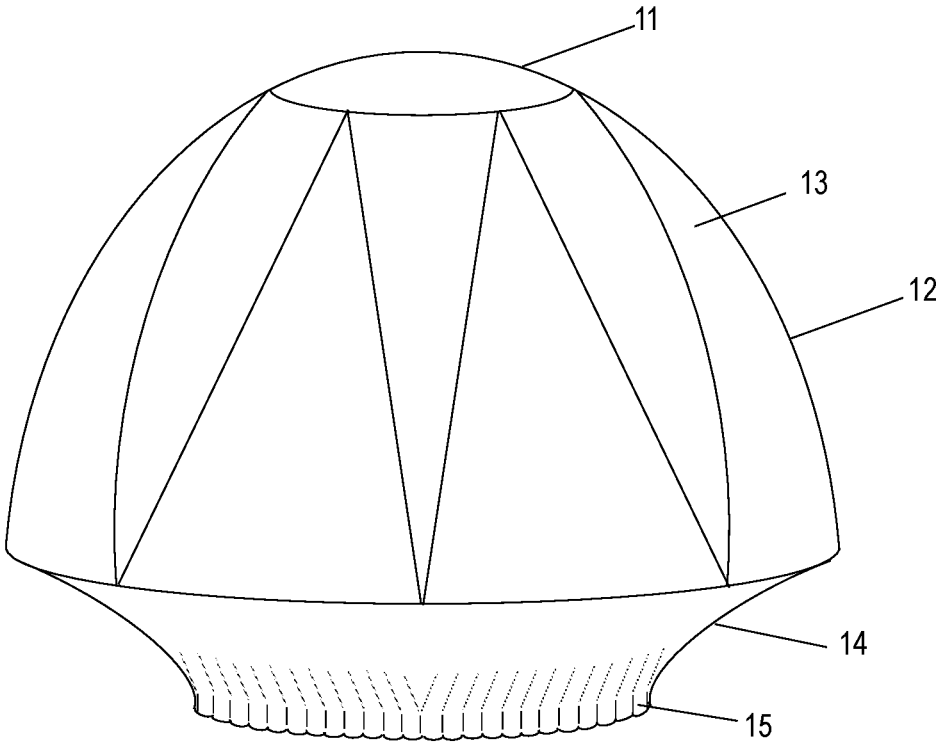
FIG. 1 is a frontal perspective view of the cap.

FIG. 1 is a frontal perspective view of the constituent portions 11, 12, and 14, of the main body of the Hair-Friendly Swimming Cap according to embodiment "A."

The upper portion 11 is a spherical cap whose shape can be achieved, among other ways, by applying darts to a circular piece of the material chosen for the cap's manufacture, or by joining by two of their sides, and making coincide in a common vertex, several triangular pieces of the selected material.

The middle portion 12 is a spherical zone composed of twelve pieces 13. Six of the pieces alternate with the other six put upside down, so as to give 12 the curvature needed to minimize its contact with the hair of the cap's wearer.

The lower portion 14 is a concave surface of revolution featuring shirring 15, stitched with elastic thread or similar. Covering part of the portion, the shirring configures the profile of the portion and the cap's opening.

Figure 2:
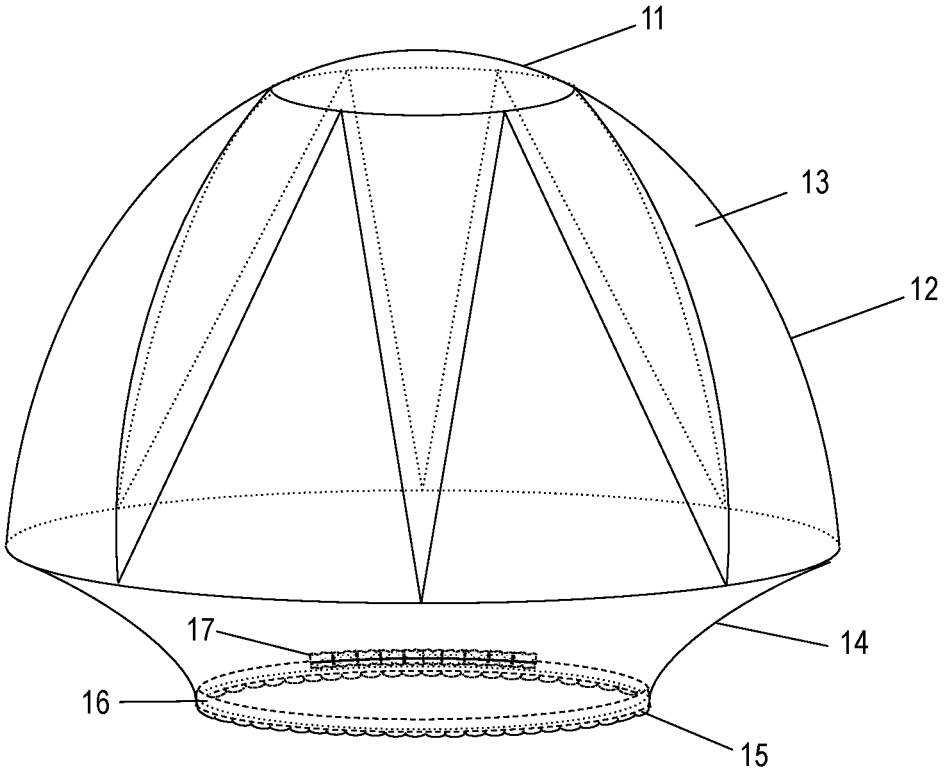
FIG. 2 is a frontal perspective inner view of the cap.

FIG. 2 provides a frontal perspective inner view of embodiment "A" of the cap showing the reverse of portions 11, 12 and 14, and the components of the positioning-blocking unit. The unit includes the clamping annular band 16, which secures the cap to the user's head, and the seepage-prevention strip 17, which keeps water from entering the cap through its edge, in the nape area.

The annular band 16 is made of rubber, latex, silicone, or analogous elastic materials, while the strip 17, which features pleats stitched with elastic thread, is made of very thin but highly absorbent microfiber, or similar material.

Figure 3:
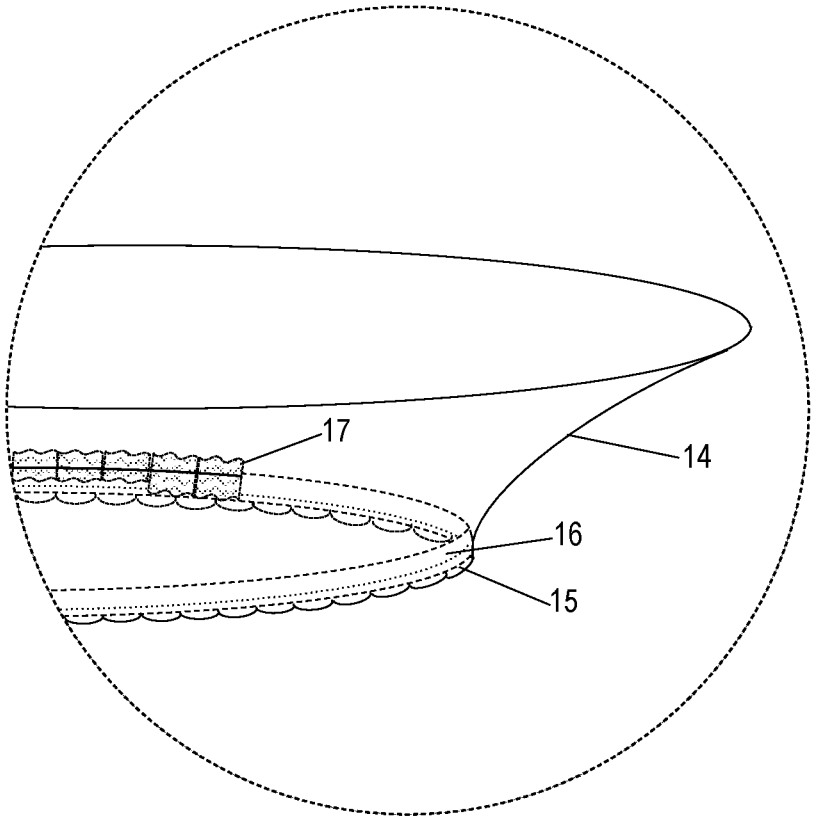
FIG. 3 is a frontal perspective inner view of an enlarged fragment of FIG. 2 spotlighting the cap's inside components 16 and 17.

FIG. 3 is a frontal perspective inner view of an enlarged fragment of the cap's lower portion 14, which spotlights the components 16 and 17 of the positioning-blocking unit. It shows the clamping annular band 16, with its lower edge stitched to the edge of the cap, and the seepage-prevention strip 17, with one of its sides sewn to the internal central portion of 16 and the other overhanging the upper edge thereof.

Since annular band 16 is sewn to 14 only by its lower edge, it exerts less pressure on the head of the cap's wearer, thus making the cap more comfortable. Furthermore, the fact that 16 is detached by its upper edge, facilitates the role of 17.

Indeed, the looseness of the upper edge of 16 increases the ability of 17, particularly of its protruding edge, to fill all nooks and crannies behind the ears and above and below the hairlines of the nape, thereby becoming an effective absorbent barrier against potential water seepage into an area whose shape and size varies greatly from one person to another.

Figure 4:
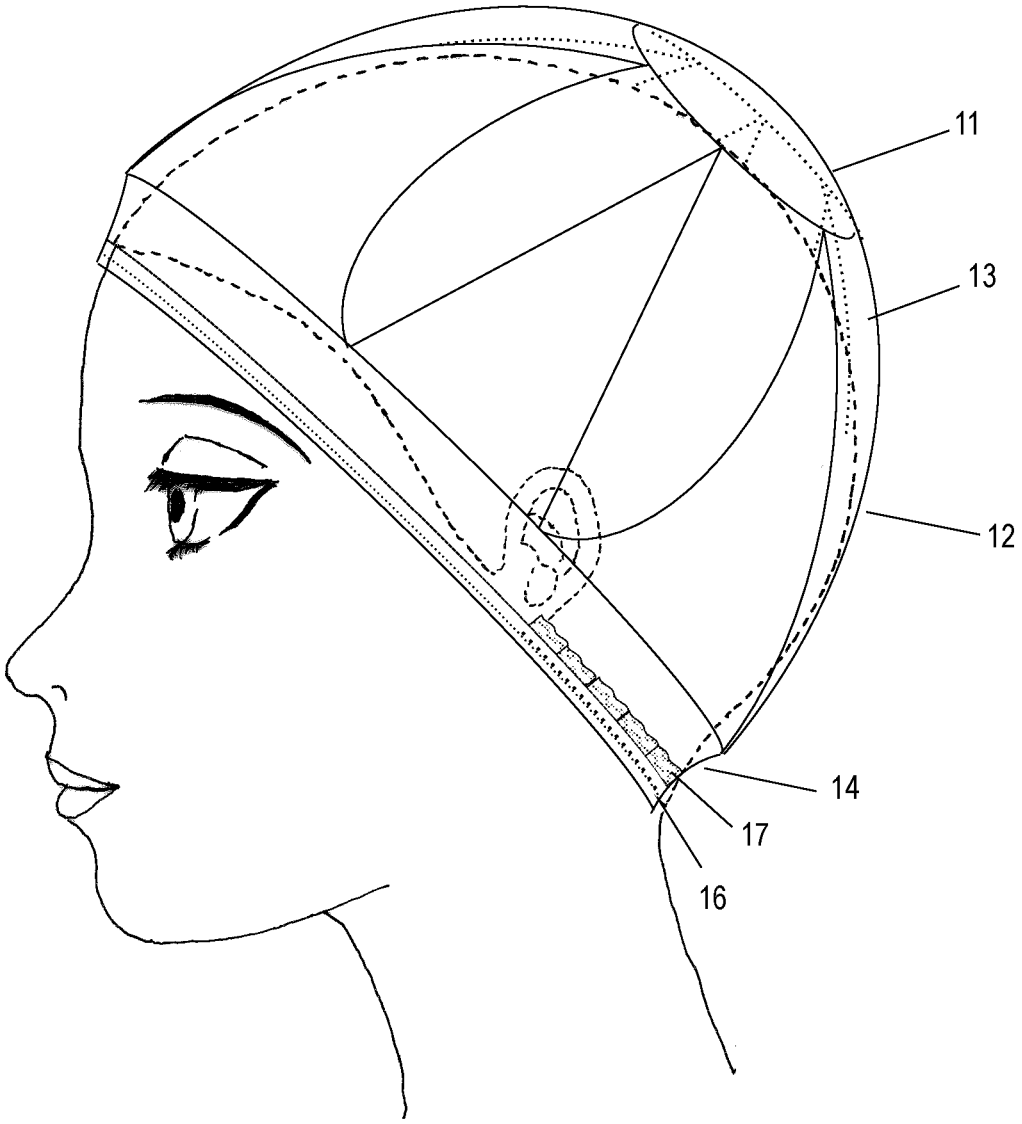
FIG. 4 is a lateral perspective inner view of the cap in wearer's head.

FIG. 4 is a lateral perspective inner view of the cap, according to embodiment "A," placed on the wearer's head. It shows upper portion 11 enfolding the top of the skull, middle portion 12 encompassing the frontal, parietal, temporal y occipital bones, and lower portion 14 stretched and contouring the left hand side of the face and neck of the wearer.

Said FIG. 4 shows the clamping annular band 16, which runs below the hairline in the frontal, sphenoid, and temporal bones, as well as below the earlobe and the nape, and the seepage-prevention strip 17, which extends from the hairline behind the ear to the bottom hairline of the neck.

FIG. 4 also reveals the hollow space between the inner side of the cap and the head of the cap's wearer. A space whose configuration owes to the three portions of the cap's main body, and that begins above the hairline at 14, gradually grows to 12, and reaches its maximum at 11, thus minimizing the compression of the hair and, hence, the flattening of the hairstyle.

The manufacture of the cap according to Embodiment "A" uses lightweight and waterproof materials like, among others, PEVA (polyethylene vinyl acetate), and silicone-coated woven nylon fabrics (e.g., silnylon). The assembling of the cap's parts resorts to appropriate techniques like sewing and gluing.

Embodiment "B"—FIG. 5

FIG. 5 is a frontal perspective view of embodiment "B" of the Hair-Friendly Swimming Cap, which differs from embodiment "A" in the format of its lower portion. While embodiment "A" resorts to shirring 15 to give its lower portion 14 its concave shape, embodiment "B" achieves the concave form of its lower portion 18 through the twelve pieces 19 that complement in reverse direction the twelve pieces 13 of the cap's middle portion 12.

The format of the embodiment's lower portion 18 allows the use of alternative materials for the manufacture of the cap's main body. Whereas embodiment "A" uses waterproof but inelastic materials, embodiment "B" resorts to highly stretchable and waterproof fabrics (like "prosoft stretch lycra waterproof," waterproof spandex, or similar ones), assembled by sewing, gluing, or other suitable means.

Differences in the type of materials used in embodiments "A" and "B" further determines differences in the type of stretching that lower portions 14 and 18 respectively experience when the cap is placed on the user's head.

Indeed, while in embodiment "A," the stretching owing to shirring 15 affects the entire lower portion 14, in embodiment "B," the bulk of the stretching of lower portion 18 falls on the six pieces 19 whose assembled bases form the edge of the cap's opening.

The other six pieces 19 experience little stretching because, given their inverted position with respect to their counterparts, they affect the opening of the cap by only one of their vertexes. Those pieces however, being connected to the six pieces 13 of the middle portion 12, ensure that the space between the skull and the inner face thereof is evenly distributed, and that it increases from the lower to the middle portions of the cap.

Although not shown in FIG. 5, the inside of the cap in embodiment "B" includes the same two components, the clamping annular band 16 and the seepage-prevention strip 17, found in embodiment "A," and depicted in FIGS. 2 and 3.

Embodiment "C"—FIGS. 6 and 7

FIG. 6 provides a frontal perspective inner view of the Hair-Friendly Swimming Cap, according to embodiment "C," which consists of a seamless piece 20, made of custom molded rubber/polymers compounds like, among others, silicones (e.g., methyl vinyl silicone).

Such piece 20 integrates portions 11 and 12 of embodiments "A" and "B" (FIGS. 1, 2, 3, 4, and 5) and portion 18 of embodiment "B" (FIG. 5). Optionally, and for aesthetic reasons, the outer surface of piece 20 could feature the ribbings of the joints of the cap's main body portions, as well as the ribbings of the joints of the 13 and 19 pieces constitutive of two of those portions.

Inwardly the cap features the clamping annular band 21. Unlike band 16 of embodiments "A" and "B," which consists of a separate item sewn or glued to 14, band 21 is but a prolongation of 20 bending inwards from the rim of the cap's opening. Like band 16, however, band 21 has its innermost edge loose.

Also inwardly, the cap features the seepage-prevention strip 17 which, instead of being sewn or glued to 16 as in embodiments "A" and "B," is kept in place over 21 by several belt loops 22, made of the same molded rubber/polymers of 20 and FIG. 7 is a frontal perspective inner view of an amplified portion of FIG. 6. It shows three of the belt loops 22 with their two ends respectively connected to the free upper edge and the center of the position-securing annular band 21, and holding the seepage-prevention strip 17 on top of such band.

The inclusion of loops 22 in embodiment "C" of the cap allows the easy removal of the seepage-prevention strip 17 for washing and drying. This possibility of removal might help prevent the premature deterioration that the strip could suffer by being surrounded by materials of little breathability, like the rubber, polymers, or similar, of which the cap is made.

CONCLUSION

The descriptions above dealt with three embodiments, among other possible ones, of the Hair-Friendly Swimming Cap, a cap for the practice of recreational swimming and other aquatic sports, by those valuing roominess, leaktightness, comfort, and sobriety. The cap achieves these values through some elements that differentiate it from its forerunners, namely:

1) an unobtrusive tripartite cavity for lodging the hair, whose lower concave portion being juxtaposed, at the level of the ears, to its convex middle and upper portions, creates a non-constrictive and stable internal space, 2) an internal annular securing band, attached by one of its edges to the rim of the cap and loose by the other one, which fits, without clenching, the head of the cap's wearer below the hairline, and 3) an absorbent strip that, cantilevered over the annular band in the neck and, optionally, in the temples, fills the irregularities that the protrusions and recesses of the head create in those areas, to stop and soak up the leaks that those might cause.

Non limitative, these elements, common to the three embodiments described, illustrate the novelty of a swimming cap whose value will be weighed in particular by the annexed claims.

The invention claimed is:

1. A swimming cap comprising;

A main body portion formed of waterproof material, the main body portion comprising;

an uppermost portion formed in the shape of a spherical cap;

a middle portion, forming spherical zone having an upper edge and a lower edge, said spherical zone consists of twelve individually formed material segments, each of the twelve segments comprising a triangle shape with a base and an apex, said upper edge of said middle portion is connected immediately adjacent to said uppermost portion;

a lower most portion forming an opening of said swimming cap, comprising a concave surface of revolution, comprising a proximal end and a distal end, said proximal end attached directly to said lower edge of said middle portion;

an internal positioning-blocking unit comprising;

an annular band made of elastic material, having a first longitudinal edge free from attachment, said annular band is positioned on said lower most portions interior surface, and is configured to secure the device to a user's head;

a seepage prevention strip comprising;

an elongated strip of absorbent material formed with a plurality of pleats along the length of the elongated strip, said seepage prevention strip is attached to said annular band such that at least a portion of said elongated strip extends past said first longitudinal edge of said annular band, configured to fill in irregular spaces in the shape of the head when the device is worn to stop and absorb water seepage.

2. The swimming cap according to claim 1, further comprising;

said lower most portion of said main body includes shirring encircling said opening of said cap.

3. The swimming cap according to claim 2, further comprising;

said main body portion comprises rigid materials including either polyethylene-vinyl acetate or silnylon.

4. The swim cap according to claim 1, further comprising;

said twelve material segments of said spherical zone are positioned in an alternating arrangement, such that said bases and said apexes align at said lower and upper edges.

5. The swim cap according to claim 4, further comprising;

said lower most portion further comprising twelve individually formed triangle material segments each having a base and an apex, said lower most portions twelve triangle segments are positioned in an alternating arrangement, such that the base and the apex of each of said twelve triangle segments are aligned at said distal and proximal ends.

6. The swim cap according to claim 5, further comprising;

said spherical zone and said lower most portion are joined such that, each of said bases of said triangle segments of said spherical zone are positioned along said lower edge are vertically aligned with each of said bases of said triangle segments of said lower most portion positioned along said proximal end of said lower most portion, in order to provide shape, strength and stability.

7. The swim cap according to claim 6, further comprising;

the main body is formed of elastane fibers.

8. The swim cap according to claim 1, further comprising;

said annular band is an extension of the lower portion folded inward at an edge of said opening.

9. The swim cap according to claim 8, further comprising;

said annular band comprising a plurality of loops;

said loops providing removable attachment for said seepage prevention strip to said annular band.

10. The swim cap according to claim 9, further comprising;

wherein said loops and annular band are made of rubber or silicone material.

* * * * *